United States Patent [19]

Hart et al.

[11] Patent Number: 4,723,481

[45] Date of Patent: Feb. 9, 1988

[54] AIR CONTROL DAMPER ASSEMBLY

[75] Inventors: Andrew J. Hart, Downsview; Michael T. Nailor, Toronto, both of Canada

[73] Assignee: Nailor-Hart Industries Inc., Toronto, Canada

[21] Appl. No.: 71,008

[22] Filed: Jul. 8, 1987

[51] Int. Cl.[4] ..... E05F 15/20

[52] U.S. Cl. ..... 98/121.2; 49/1; 98/1; 251/129.11; 251/279

[58] Field of Search ..... 98/1, 110, 121.2; 49/1, 49/4; 137/601; 251/129.11, 279

[56] References Cited

U.S. PATENT DOCUMENTS

| | | | |
|---|---|---|---|
| 1,052,611 | 2/1913 | Moody | 49/1 |
| 3,967,779 | 7/1976 | Logsdon | 137/601 X |
| 4,301,569 | 11/1981 | McCabe | 49/1 |
| 4,581,987 | 4/1986 | Ulicny | 98/110 X |

FOREIGN PATENT DOCUMENTS

| | | | |
|---|---|---|---|
| 1185581 | 3/1970 | United Kingdom | 98/119 |

OTHER PUBLICATIONS

Nailor-Hart Industries Inc.—Installation Drawing—Std. Control Damper Electric Motor Drive Unit to Jack Shaft—dated Mar. 28, 1984.

Nailor-Hart Industries Inc.—Installation Drawing—Damper Drive Electric Motor Unit to Damper Drive Pin—dated Mar. 26, 1984.

Nailor-Hart Industries Inc.—Installation Drawing—1250 Control Damper Electric Motor Drive Unit to Jack Shaft—dated Mar. 22, 1984.

*Primary Examiner*—Harold Joyce

*Attorney, Agent, or Firm*—Rogers, Bereskin & Parr

[57] ABSTRACT

An air control damper is provided with an actuator coupled to a shaft for operating the blades of the damper. The actuator includes an electric drive motor that turns the shaft by way of a lever that is coupled to the shaft. The lever has a pulley at an outer end and a cable extends from the drive motor around the pulley and back to a fixed point adjacent the motor. When the motor is operated, the cable is wound around the motor drive shaft, pulling the lever towards the motor and turning the shaft. The arrangement provides a mechanical advantage in transmitting the motor output force to the blade actuating shaft.

12 Claims, 6 Drawing Figures

AIR CONTROL DAMPER ASSEMBLY

FIELD OF THE INVENTION

This invention relates generally to air control dampers.

BACKGROUND OF THE INVENTION

An air control damper generally comprises a frame dimensioned to fit inside a particular duct, and a series of louver-like blades or leaves that extend across the frame. The blades are pivoted to the frame for movement between an open position in which air can flow along the duct and a closed position in which the duct is effectively closed. Movement of the blades may be accomplished in various ways depending on the event to which the damper is intended to respond.

Air control dampers can be designed to respond to the presence of harmful gasses and/or smoke; such dampers may be designed as smoke dampers, fire dampers or combination smoke and fire dampers. A smoke damper will be typically be designed to close automatically in response to a signal indicating the presence of smoke, for example from a smoke detector. A fire damper will be designed to close automatically in the presence of heat. For example, the blades of the damper may be spring-biassed towards a closed position but held open by a fusible link that melts when exposed to a predetermined temperature. Combination units respond to either smoke or heat.

DESCRIPTION OF THE PRIOR ART

It has been recognized as desirable for an air control damper to be designed to close automatically in the event of a power failure in the building in which the damper is installed. This has been done by providing the damper with a spring biassed blade closing mechanism and a blade actuator that includes an electric drive motor and a clutch designed to release and permit the blades to close in the event that power to the motor is interrupted.

BRIEF DESCRIPTION OF THE INVENTION

An object of the present invention is to provide an improved air control damper having an improved actuator for opening or closing the blades.

The air control damper provided by the invention includes a frame surrounding an opening for air flow through the damper, at least one blade pivotally coupled to the frame for movement between an open position permitting such air flow, and a closed position in which such flow is at least substantially prevented, and means for moving the blades between said open and closed position. These means include the drive motor having a rotary output shaft extending about an axis, a blade actuating linkage including a driven shaft extending about an axis generally parallel to the axis of the drive motor output shaft and means for transmitting rotary motion of the drive motor output shaft to the driven shaft. These transmitting means include an elongate tension element coupled at a first end to the drive motor output shaft at a position spaced radially from the axis of the shaft so as to be wound about the shaft upon rotation thereof in one direction, a drive transmitting member coupled to the driven shaft and pulley means on the member spaced from the axis of the driven shaft. The elongate tension element extends from its first end around the pulley means and returns towards the driving shaft to a fixed point at a second end of the element so that turning of the rotary output shaft in a direction to wind the tension element about the shaft causes the element to draw the pulley means towards the driving shaft, turning the driven shaft and causing the blade or blades to either open or close, depending on the design of the damper.

Preferably, the drive motor will be arranged to open the blades and the blades will be spring biassed towards their closed position. The drive motor may (but need not necessarily) include a clutch designed to release in the event that power to the motor is interrupted so that the blades will close automatically under the effect of their spring biassing.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF THE PREFERRED EMBODIMENTS

The drawings show an air control damper that is designed to close automatically when exposed to heat above a predetermined temperature or in the event of a power interruption. In other words, the damper is essentially a fire damper that also responds to power interruptions.

Figure 1:
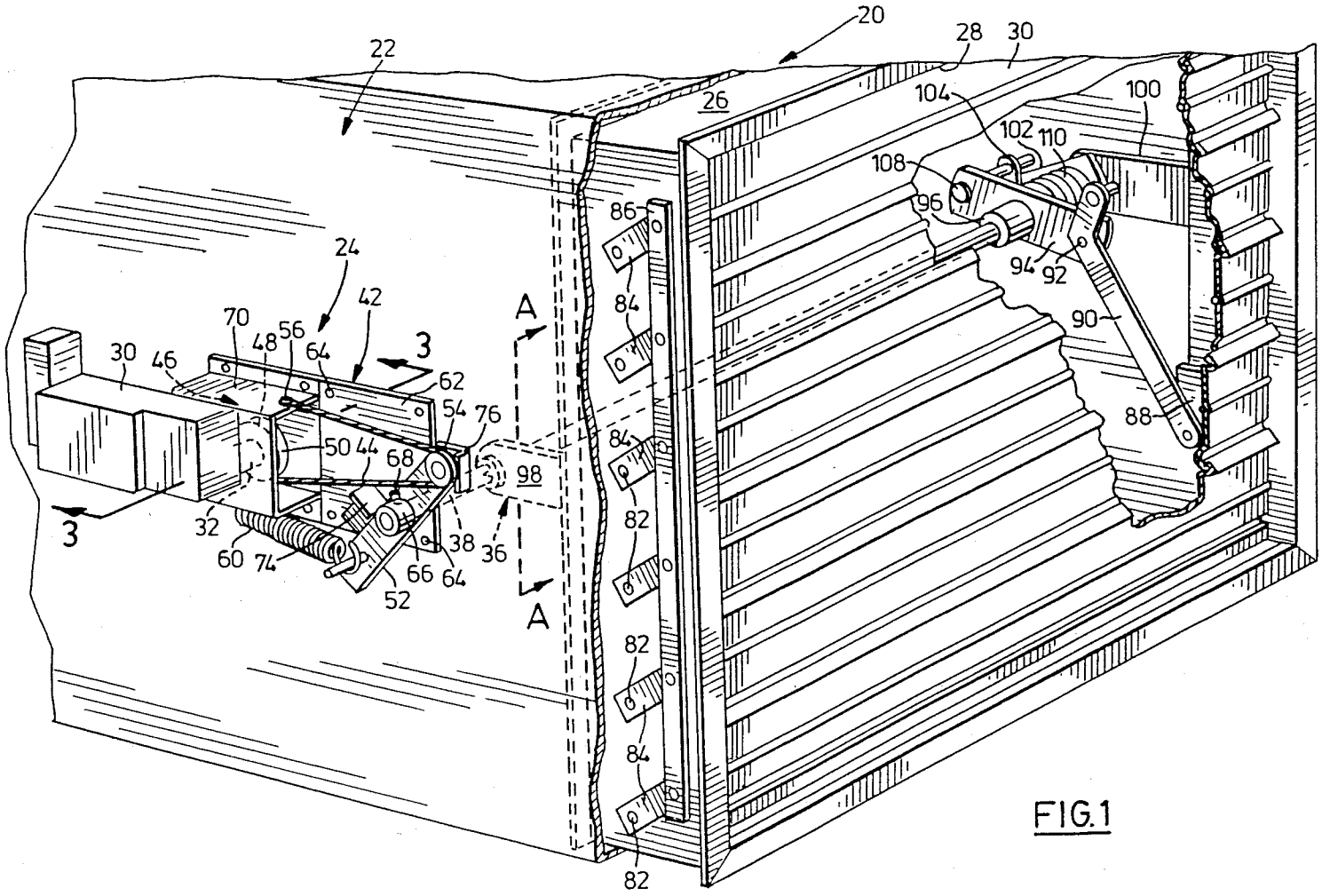
FIG. 1 is a perspective view, partly broken away, of an air control damper assembly in accordance with the invention.
Figure 6:
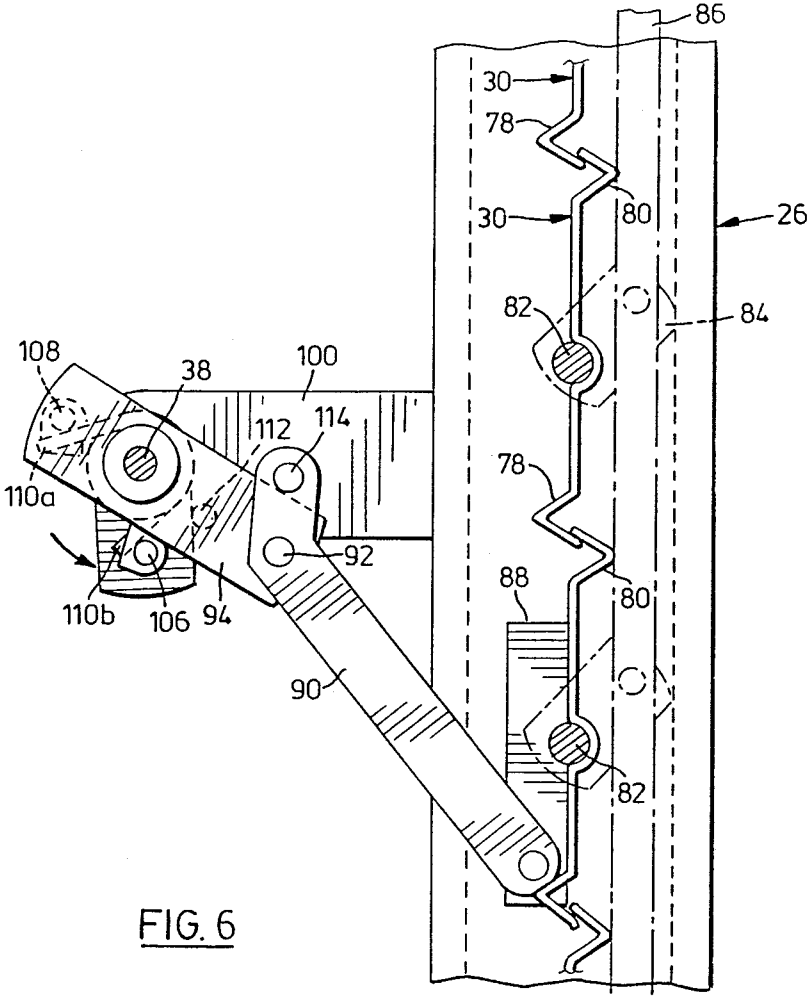
Figure 4:
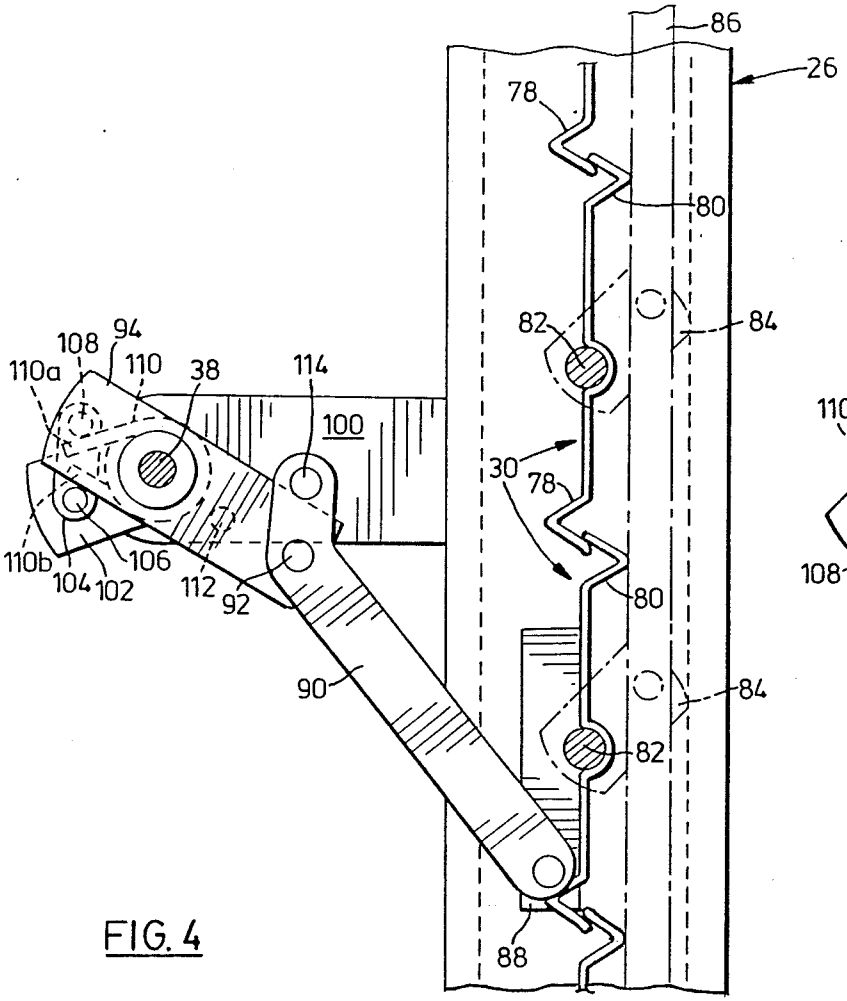

Referring first to FIG. 1, a fire damper assembly is shown to comprise a damper generally denoted 20 installed within an air duct 22 and an actuator 24 mounted on a side wall of the duct 22. The damper itself includes a rectangular frame 26 which is dimensioned to fit closely within the air duct 22 and which surrounds an opening 28 for permitting air flow through the damper. A series of blades extend across the opening 28 and are pivotally coupled to the frame 26 for movement between open positions for permitting air flow through the damper (see FIG. 5) and closed positions in which they are shown in FIGS. 1, 4 and 6. In the closed positions, the blades at least substantially prevent air flow through the damper and consequently along the duct.

Figure 2:
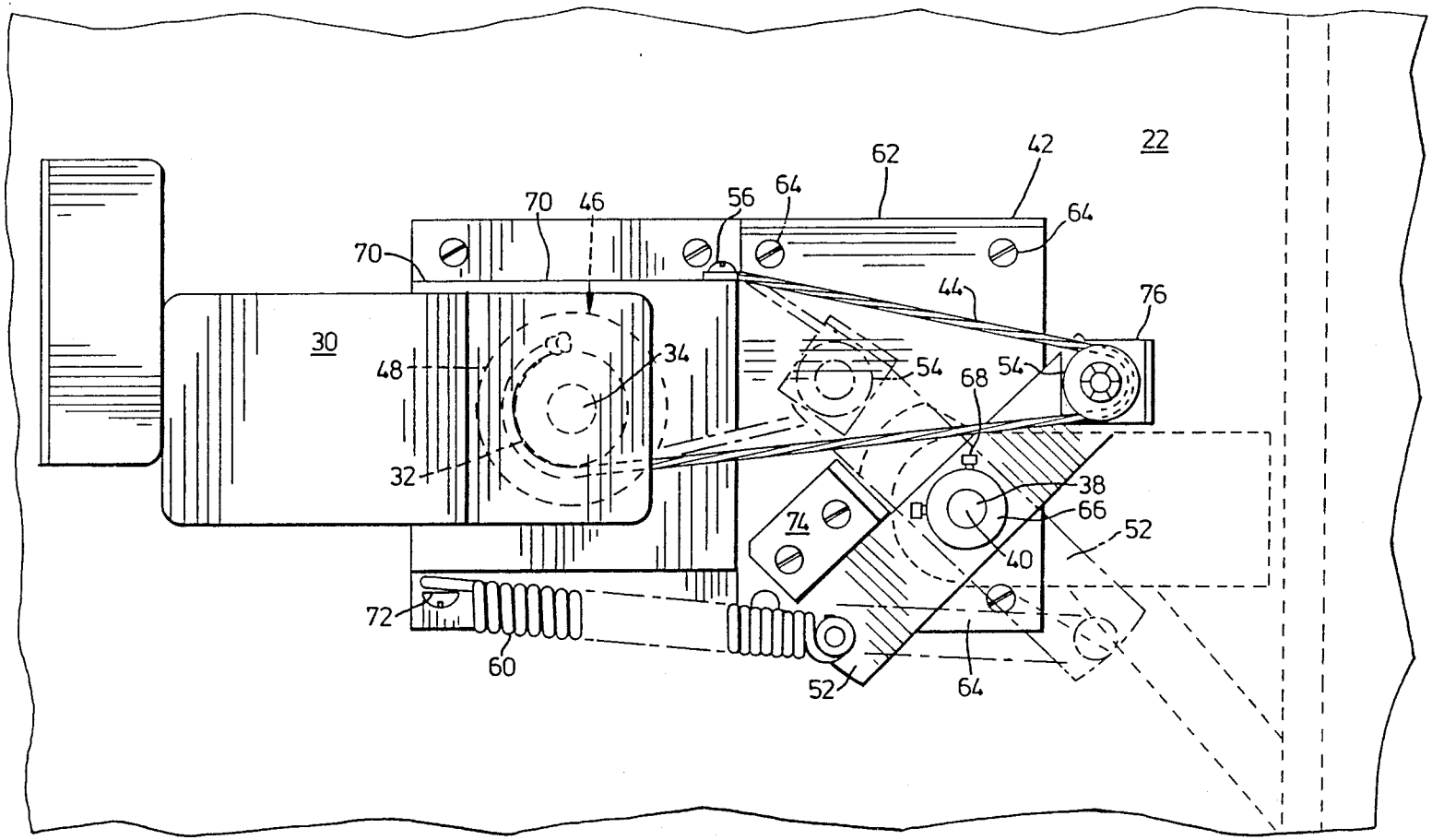
FIG. 2 is a side elevational view of the blade actuator of the damper shown in FIG. 1.

In this particular design of damper, the blades are spring biassed to their closed positions and can be moved to and held in their open positions by the actuator 24. Actuator 24 includes an electric drive motor 30 having a rotary output shaft 32 that extends about an axis denoted 34 in FIG. 2. The damper itself includes a blade actuating linkage that is generally denoted 36 in FIG. 1 and that will be more specifically described later. For present purposes, it is sufficient to note that linkage 36 includes a driven shaft 38 that extends parallel to the motor drive shaft 32 and that, by turning shaft 38 in the counter-clockwise direction as shown in FIG. 1 and 2, all of the blades 30 are simultaneously moved from their closed positions to their open positions. In FIG. 2, the longitudinal axis of shaft 38 is denoted 40.

Actuator 24 includes means generally denoted 42 for transmitting rotary motion of the drive motor output shaft 32 to the driven shaft 38. These transmission means include an elongate tension element shown in this embodiment as a cable 44 that is coupled at a first end to the drive motor output shaft 32 at a position spaced radially from the axis 34 of the shaft (see FIG. 2). In this particular embodiment, the cable is connected to the shaft by way of a pulley assembly 46 that is keyed to the shaft. This assembly incorporates a clutch (to be described) and includes a pulley 48 having a grooved peripheral surface 50 (FIG. 1) in which the cable 44 lies in being wound about shaft 32.

Secured to the driven shaft 38 is a drive transmitting member in the form of a lever 52 which carries at one end a pulley 54 spaced from the rotational axis 40 of the shaft, as best seen in FIG. 2. With continued reference to that view, it will be seen that cable 44 extends from its "first" end at which it is secured to pulley 48, around the pulley 54 and then returns towards the driving shaft 32 to a fixed point 56. It will be appreciated that turning of shaft 32 in a direction to wind the cable 44 about the shaft (the clockwise direction as drawn in FIG. 2) will cause the cable to draw the pulley 54 towards shaft 32, turning shaft 38 and causing the blades to move from their closed positions to their open positions. In FIG. 2, lever 52 is shown in ghost outline in a position corresponding to the open positions of the blades.

It can be seen from FIG. 2 that, at this time, the effective length of cable 44 between pulley 48 and the fixed point 56 has been shortened substantially by a portion of the cable having been wound onto pulley 48.

It will also be appreciated that this arrangement results in the force applied to lever 52 for opening the blades having been almost doubled as compared with the force that would have been applied if the outer end of cable 44 had been fixed directly to lever 52. The motor output shaft 52 has of course had to turn through a greater angular distance than would have been necessary in such an arrangment and the work done by the motor is therefore the same. However, a mechanical advantage has been gained. This allows the use of a drive motor (30) of a lower rated output force than would otherwise have been necessary. For example, in practical tests, it is believed that the mechanical advantage may be as high as 4:1 and that a motor having a rated output torque of 45 foot pounds may by this arrangement be capable of exerting as much as a 150 foot pounds torque to the blade actuating linkage.

Figure 3:
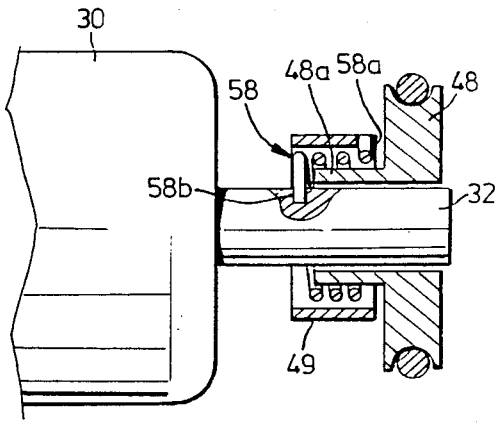
FIG. 3 is a somewhat diagrammatic cross-sectional view generally on the line denoted 3—3 of FIG. 1 illustrating the form of clutch used in the motor drive.

Motor 30 is designed so that, once the blades have reached their fully open positions, they will be held there with the motor under power but in a stall condition. The pulley assembly 46 that is carried by the motor drive shaft 32 is designed so that the pulley will release from the drive shaft in the event that power to the motor is interrupted. This is accomplished by a clutch that is incorporated in the assembly between shaft 32 and pulley 48. The arrangement has been illustrated in FIG. 3, in somewhat diagrammatic form only since clutches of this type are well known and commercially available. Referring to that view, motor output shaft 32 is coupled to pulley 48 by a spring 58 that is spirally wound around a collar **48*a* on pulley 48 and engaged at one end (58*a*) with a fixed sleeve 49 and at the other, 58*b* with shaft 32. Spring 58 is arranged so that, when shaft 32 turns in the appropriate rotational direction (the clockwise direction as shown in FIG. 2) the spring will tighten around collar 48*a*, coupling the pulley and shaft together. The spring will remain in this condition after the motor has turned through a sufficient angular distance to move the blades of the damper to their fully open positions, and the motor has stalled. However, in the event that power to the motor is interrupted, a turning force will no longer be applied to shaft 32, the spring 58** will relax and effectively release the pulley from its coupling to the shaft.

Referring back to FIG. 2, the lever 52 that carries pulley 54 is a double-armed lever as shown and a return spring 60 is coupled between the lower end of lever 52 and a fixed point on a mounting bracket for the motor so that, when the clutch assembly releases pulley 48 from shaft 32, the pulley will be turned in the counter-clockwise direction as shown, allowing the blades to close.

Referring back to FIG. 1, it will be seen that actuator 24 is in fact a self-contained unit that is mounted on the side wall of duct 22. The driven shaft 38 for the blade actuating linkage forms part of the damper itself (26) and simply extends through an opening in the duct wall. Damper 26 itself is essentially representative of typical conventional dampers that are installed in this fashion. As such, it is possible for existing dampers to be in a sense "converted" by replacing the existing blade actuator with an actuator of the form provided by the invention. The actuator need simply be attached to the side wall of the duct and coupled to the driven shaft (as shaft 38) without the need for any modification of the damper itself, or entry to the duct.

To this end, the components of actuator 24 are all carried by a single base plate that is predrilled with holes for self-tapping screws 64, and a hole (not visible) through which the driven shaft 38 can extend. Thus, all that is necessary is to attach the base plate 62 of the actuator to the side wall of the duct after positioning it over the shaft 38. Lever 52 has a collar 66 at its center provided with a clamp screw 68 that can be tightened onto the shaft 38. Motor 30 is supported from the base plate 62 by a channel section 70 that is attached to the base plate with the base of the channel spaced outwardly from the plate so as to define a space for receiving pulley assembly 46. The "second" fixed end of cable 44 is attached to this channel section at 56. Return spring 60 is secured to the opposite side limb of the channel by screw 72 (FIG. 2). Base plate 62 also carries a stop 74 for defining the position of the lever to which is returned by spring 60, and a cable guard 76 which extends around the pulley 54 in this position of the lever.

Figure 5:
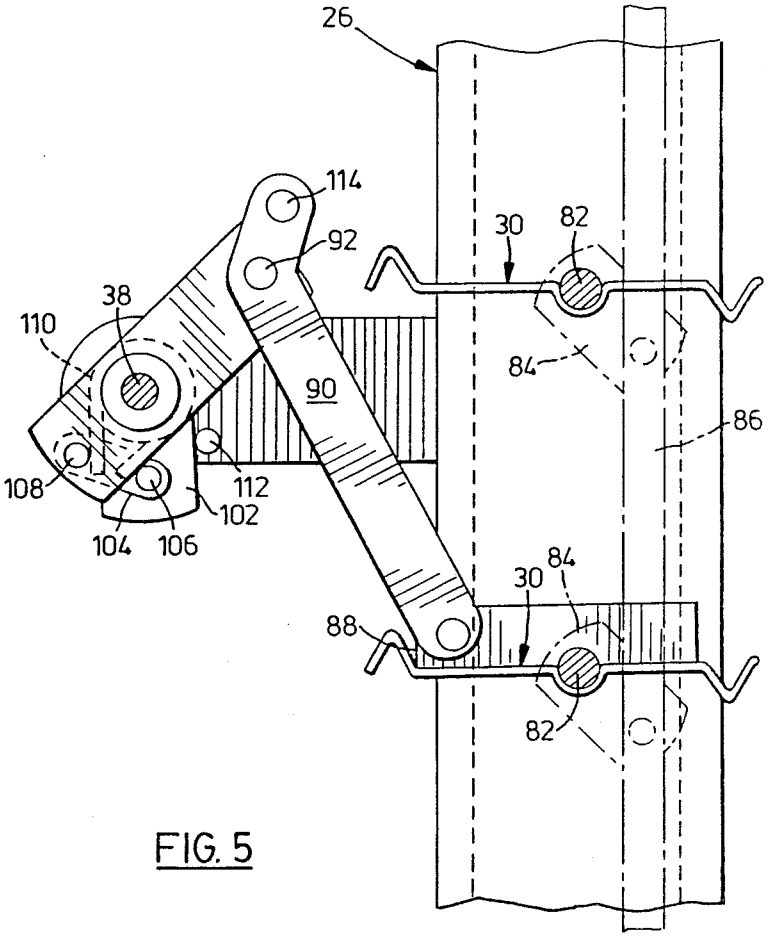
FIGS. 4 and 5 are side elevational views generally in the direction of arrows "A" in FIG. 1; showing the blade operating linkage of the damper in closed and open positions respectively; and, FIG. 6 is a view similar to FIGS. 4 and 5 showing the linkage after the blades have closed following exposure to heat.

Referring now to FIGS. 4, 5 and 6, it will be seen that each of the blades 30 of the damper is essentially a roll formed metal section with V-shaped formations 78, 80 along respective longitudinal edges arranged so that the formations of adjacent blades engage with one another as best shown in FIGS. 4 and 6 to maintain the integrity of the closure in the closed positions of the blades. Each blade is carried by a shaft 82 that extends transversely of the frame 26 of the damper and is received in sleeves (not shown) in the side members of the frame that allow the shaft to turn freely.

The blades are coupled together so that they move in unison between their open and closed positions by a linkage arrangement that is best shown in FIG. 1. The shafts 82 carrying the blades extend through the side members of the frame. The protruding end portions of the shafts 82 at one side of the frame are fitted with short links 84 that are privotally coupled to a vertically moveable link 86. In FIG. 1, the blades are shown broken away adjacent the opposite side of the frame to illustrate the coupling of the driven blade actuating shaft 38 to the blades. In fact, the shaft is coupled to only one of the blades 30 but the blades move in unison because of the linkage arrangement just described. The blade in question (shown as the second blade from the bottom in FIG. 1) is fitted on its inner side with a bracket 88 to which is pivotally coupled a cranked link 90 that is in turn pivoted at 92 to a further link 94 through which extends the blade actuating shaft 38. Shaft 38 is not in fact coupled to link 94 but the link carries a sleeve 96 through which the shaft extends. As best seen in FIG. 1, shaft 38 is in fact turnably mounted in two brackets 98 and 100 that extend rearwardly from opposite side members of the damper frame 26. Immediately adjacent bracket 100, shaft 38 is fitted with a link 102 that turns with the shaft and that is coupled to link 94 by a fusible link 104.

The arrangement is perhaps best illustrated in FIGS. 4 and 5 from which it will be seen that link 104 is coupled adjacent its end to the respective links 102 (carried by shaft 38) and 94 (turnable on shaft 38) by respective pins 106 and 108. It will be seen from FIG. 1 that the fusible link 104 is in fact disposed quite close to link 102 but spaced from link 94 to accommodate a spring 110. Referring back to FIGS. 4 and 5, spring 110 has end portions 110a and 110b that bear against the respective pins 106 and 108 at the ends of the fusible link so as to bias those pins apart. However, while the fusible link remains intact spring 110 has no affect on the blade operating linkage.

A comparison of FIGS. 4 and 5 will show that when shaft 38 is turned in the counter-clockwise direction as shown, link 102 will turn with the shaft and, through the fusible link 104, will turn link 94 on shaft 38. This in turn will pull link 90 upwardly, opening the blade to which the link is coupled and also the other blades 30 by virtue of their interconnection by the links 84 and 86. A stop 112 on bracket 100 defines the fully open position of the blades (FIG. 5). In the fully closed position, a stop 114 on the cranked outer end portion of link 90 bears against the top edge of link 94 as best shown in FIG. 4.

In the event that the damper is exposed to a predetermined high temperature at which the fusible link 104 will melt, spring 110 will force apart the two pins 106 and 108, causing link 94 to turn in a counter-clockwise direction as drawn and close all of the blades as shown in FIG. 6.

It will of course be appreciated that the preceding description relates to a particular preferred embodiment of the invention only and that the invention is not limited to the particular details described.

For example, an actuator of the form provided by the invention may be used with dampers other than of the type specifically shown. Also, the actuator could be used to close the blades rather than open them. It is not essential for the motor drive to incorporate a clutch that will release when power to the motor is interrupted, as described. For example, limit switches could be provided to switch off the motor when the blades reach the end of their travel. Other specific details of the actuator that may change are that the pulley 54 could for example be replaced by a plain pin around which the cable 44 would run. The cable itself could be replaced by some other form of tension element. Also, it is not essential for the tension element to be wound onto a pulley carried by the motor output shaft; it could be wound directly around the shaft itself.

We claim:

1. An air control damper assembly comprising:
(a) a frame surrounding an opening for air flow through the damper;
(b) at least one blade pivotally coupled to the frame for movement between an open position permitting such air flow, and a close position, in which such flow is at least substantially prevented; and,
(c) means for moving the blade between said open and closed positions, said means including:
(i) a drive motor having a rotary output shaft extending about an axis;
(ii) a blade actuating linkage including a driven shaft extending about an axis generally parallel to said axis of the drive motor output shaft; and,
(iii) means for transmitting rotary motion of said drive motor output shaft to said driven shaft, comprising: an elongate tension element coupled at a first end to said drive motor output shaft at a position spaced radially from said axis of the shaft so as to be wound about the shaft upon rotation thereof in one direction; a drive transmitting member coupled to said driven shaft; and pulley means on said member spaced from said axis of the driven shaft; said elongate tension element extending from its said first end around said pulley means and returning towards said driving shaft to a fixed point at a second end of the element so that turning of said rotary output shaft in a direction to wind said tension element about said output shaft causes the said element to draw the pulley means towards the driving shaft, turning the driven shaft and causing said at least one blade to move from one of its open and closed positions to the other of its said positions.

2. A damper assembly as claimed in claim 1, wherein said means for moving the blade between said open and closed positions includes spring means biassing said at least one blade to its closed position and wherein said drive motor is adapted to move the blade from its closed position to its open position.

3. A damper assembly as claimed in claim 2, wherein said motor is designed to operate continuously under power and to stall in said open position of the blade.

4. A damper assembly as claimed in claim 1, wherein said drive transmitting member comprises a lever coupled to said driven shaft, and wherein said pulley means comprises a pulley turnably mounted on the lever.

5. A damper assembly as claimed in claim 1, wherein said drive motor output shaft is provided with a pulley assembly by which the tension element is coupled to the drive shaft at a position spaced radially from its said axis and onto which the tension element is wound upon turning of said rotary output shaft in the appropriate direction.

6. A damper assembly as claimed in claim 5, wherein said drive motor is an electric motor and wherein said pulley assembly comprises a pulley and clutch means coupling said pulley to said drive motor output shaft, said clutch means being adapted to decouple the pulley from the shaft in the event that power to the motor is interrupted.

7. A blade actuator for an air control damper comprising a frame surrounding a opening for air flow through the damper, at least one blade pivotally coupled to the frame for movement between an open position permitting such air flow and a closed position in which such flow is at least substantially prevented, and means for moving the blade between said open and closed positions including a driven shaft extending about an axis;

said actuator comprising a self-contained unit adapted to be coupled to said driven shaft and including a drive motor having a rotary output shaft extending about an axis intended to be disposed parallel to said axis of the driven shaft, and means for transmitting rotary motion of said drive motor output shaft to said driven shaft in use, said means including an elongate tension element coupled at a first end of said drive motor output shaft at a position spaced radially from said axis of the shaft so as to be wound about the shaft upon rotation thereof in one direction, a drive transmitting member adapted to be coupled to said driven shaft, and pulley means on said member spaced from said axis of the driven shaft when the drive transmitting member is coupled to said shaft; said elongate tension element extending from its said first end around said pulley means and returning towards said driving shaft to a fixed point at a second end of the tension element.

8. An actuator as claimed in claim 7, wherein said motor is designed to operate continuously under power and to stall in said open position of the blade.

9. An actuator as claimed in claim 7, wherein said drive transmitting member comprises a lever adapted to be coupled to a said driven shaft, and wherein said pulley means comprises a pulley turnably mounted on the lever.

10. An actuator as claimed in claim 7, wherein said drive motor output shaft is provided with a pulley assembly by which the tension element is coupled to the drive shaft at a position spaced radially from its said axis and onto which the tension element is wound upon turning of said rotary output shaft in the appropriate direction.

11. An actuator as claimed in claim 10, wherein said drive motor is an electric motor and wherein said pulley assembly comprises a pulley and clutch means coupling said pulley to said drive motor output shaft, said clutch means being adapted to decouple the pulley from the shaft in the event that power to the motor is interrupted.

12. An actuator as claimed in claim 7, including a base plate adapted for mounting on a wall of an air duct in which a said air control damper is mounted, with said driven shaft extending through an opening in said wall, said base plate including an opening through which said driven shaft extends when the actuator is installed on said wall, and said drive motor being mounted on the base plate.

* * * * *